US008802198B2

(12) United States Patent
Warichet et al.

(10) Patent No.: US 8,802,198 B2
(45) Date of Patent: Aug. 12, 2014

(54) FLUX AND FLUXING BATH FOR HOT DIP GALVANIZATION, PROCESS FOR THE HOT DIP GALVANIZATION OF AN IRON OR STEEL ARTICLE

(75) Inventors: David Warichet, Brussels (BE); Gentiana Kone, Deurne (BE); Anthony Vervisch, Melle (BE)

(73) Assignee: Galva Power Group N.V. (BE)

( * ) Notice: Subject to any disclaimer, the term of this patent is extended or adjusted under 35 U.S.C. 154(b) by 235 days.

(21) Appl. No.: 13/144,309

(22) PCT Filed: Jan. 18, 2010

(86) PCT No.: PCT/EP2010/050542

§ 371 (c)(1),
(2), (4) Date: Aug. 22, 2011

(87) PCT Pub. No.: WO2010/081905

PCT Pub. Date: Jul. 22, 2010

(65) Prior Publication Data

US 2011/0293838 A1 Dec. 1, 2011

(30) Foreign Application Priority Data

Jan. 16, 2009 (EP) ..... 09150777

(51) Int. Cl.
*B05D 1/18* (2006.01)

(52) U.S. Cl.
USPC ..... 427/433; 427/431

(58) Field of Classification Search
CPC ..... C23C 2/00; C23C 2/12; C23C 2/30; C23C 2/22
USPC ..... 427/431, 433
See application file for complete search history.

(56) References Cited

U.S. PATENT DOCUMENTS

2003/0219543 A1* 11/2003 Warichet et al. ..... 427/433

FOREIGN PATENT DOCUMENTS

| | | | |
|---|---|---|---|
| EP | 1209245 | A1 | 5/2002 |
| JP | 05017860 | | 1/1993 |
| LU | 75821 | A1 | 5/1977 |
| WO | 03057940 | A1 | 7/2003 |
| WO | WO 03057940 | A1 * | 7/2003 |
| WO | 2007146161 | A1 | 12/2007 |

OTHER PUBLICATIONS

International Search Report PCT/EP2010/050542; Dated Apr. 27, 2010.

* cited by examiner

*Primary Examiner* — Michael Cleveland
*Assistant Examiner* — James M Mellott
(74) *Attorney, Agent, or Firm* — Cantor Colburn LLP

(57) ABSTRACT

The present invention generally relates to a flux for hot dip galvanization comprising from: 36 to 80 wt. % (percent by weight) of zinc chloride ($ZnCl_2$); 8 to 62 wt. % of ammonium chloride ($NH_4C$); from 2.0 to 10 wt. % of a least one of the following compounds: $NiCl_2$, $MnCl_2$ or a mixture thereof. The invention further relates to a fluxing bath, a process for the hot dip galvanization of an iron or steel article as well as to the use of said flux.

11 Claims, 3 Drawing Sheets

| | | | | |
|---|---|---|---|---|
| 1 | 2 | 3 | 4 | 5 |
| 6 | 7 | 8 | 9 | 10 |

| | | | | | | | | |
|---|---|---|---|---|---|---|---|---|
| 1 | 2 | 3 | 4 | 5 | 6 | 7 | 8 | 9 |
| 10 | 11 | 12 | 13 | 14 | 15 | 16 | 17 | 18 |

FLUX AND FLUXING BATH FOR HOT DIP GALVANIZATION, PROCESS FOR THE HOT DIP GALVANIZATION OF AN IRON OR STEEL ARTICLE

TECHNICAL FIELD

The present invention generally relates to a flux and a fluxing bath for hot dip galvanization, to a process for the hot dip galvanization of an iron or steel article.

BACKGROUND

Conventional hot dip galvanization consisting of dipping iron or steel articles in a molten zinc bath requires careful surface preparation, in order to assure adherence, continuity and uniformity of the zinc coating. A conventional method for preparing the surface of an iron or steel article to be galvanized is dry fluxing, wherein a film of flux is deposited on the surface of the article before dipping it in the zincbath. Accordingly, the article generally undergoes a degreasing followed by rinsing, an acid cleaning also followed by rinsing, and a final dry fluxing, i.e. the article is dipped in a fluxing bath and subsequently dried. The basic products employed in conventional fluxing are generally zinc and ammonium chlorides.

Several important problems are currently encountered in the batch hot dip galvanizing or general galvanizing industry:

Problem No 1:

It has been proved that adding 250 to 500 ppm Aluminum to a classic zinc bath has a benefic influence on several factors: thinner zinc layer on Si-rich steel (Si>0.28%), as well as better drainability of the molten zinc alloy.

However, it is also well known that galvanizers that have tried to galvanize material with conventional flux in zinc bath containing 200 to 500 ppm Al have been confronted with a problem.

In particular, some areas of the surface may not be covered, or not be covered in a sufficient manner, or the coating may show black spots or even craters, which give the article unacceptable finish and/or corrosion resistance. Thus, research has been carried out to develop a pre-treatment process and/or fluxes and/or additives in the molten zinc that are more adapted to galvanize with zinc alloy containing Al 200-500 ppm. Despite these efforts, when it comes to the galvanizing of iron or steel articles in zinc-aluminum baths in batch operation, i.e. the galvanizing of individual articles, the known fluxes are still not satisfactory.

Problem No 2:

In order to galvanize steel parts in a correct and safe way, different types of holes are necessary in the steel constructions or articles;

a. holes in order to let the molten zinc access to all the zones of the construction/article
b. holes necessary in order to allow air, gases due to the melting of the flux ($NH_4Cl$, $AlCl_3$, water) to escape. A lot of documents exist that explain the best procedures to place the holes and to size them.

However in the daily production, it is unfortunately frequent that in some articles the holes are too small and/or badly positioned (see FIG. 1). In such conditions, an important quantity of liquid (fluxing bath) is trapped in the construction and once it comes in contact with the molten zinc bath, large amounts of gas are produced leading to an explosion with the projection of up to several kilograms of molten zinc in the air above the zinc bath's surface. The molten zinc that has been projected reaches parts of the article that have not yet been dipped in the molten zinc and will stick to them. Depending on the thickness of the article, the importance of the zinc splashes (how much g Zinc/$m^2$) and the composition of the zinc bath, the flux layer can be destroyed leading to poor wetting of the molten zinc and resulting in ungalvanized zones! When the zinc bath contains from about 200 to about 500 ppm aluminum, this phenomenon is clearly worse than with lower aluminum contents. The presence of aluminum catalyses the quick burning of the flux layer and because these explosions cannot be completely avoided, it is a major problem of galvanizing with 200-500 ppm Al.

Problem No 3:

A good drying of the flux layer is necessary in order
to avoid explosions,
to allow a as high as possible dipping speed. A high dipping speed diminishes the risk of Liquid Metal Embrittlement (also called Liquid-Metal-Assisted-Cracking)
to minimize the production of ashes and to minimize the zinc use (kg zinc/ton material)

The best case would be to bring the material to be galvanized at 100° C. as quickly as possible in order to make sure that all water has been evaporated and that the flux is not yet burned (damaged). In the daily practice of BHDG (Batch Hot Dip Galvanizing also called General Galvanizing) one is confronted with three factors:

a. The galvanizing of constructions made out of steel parts of different thickness. For example, a water tank for a farmer is made out steel plates and profiles of 5, 8 and 12 mm. After drying, the parts have different temperatures depending on their thickness: thinner parts are hotter and thicker parts are colder.
b. The number of positions in the dryer are limited usually to two positions thus in order to follow the production rhythm, higher air temperature and higher turbulence are required to achieve drying in a sufficiently short time,
c. Sometimes the production has to be stopped for 30 minutes (for example during lunch breaks), some dips can take 40 minutes to be galvanized and therefore some material already in the dryer may have to stay there for 3 hours in the longer case and in the shorter case for only 10 minutes!

The consequences of these factors is that some parts (thin parts) may sometimes reach the air temperature used for the drying and begin to corrode heavier in the dryer and thicker parts can sometimes be too cold and be still wet and this can induce explosions as mentioned above when entering the molten zinc bath.

Problem No 4:

Some articles may only be dipped very slowly into the molten zinc because these articles are hollow and the size of the openings is limited as is the case for example with kettles for compressed air and with kettles for water under pressure. Because of the pressure requirements of such articles, smaller opening sizes are necessary and it takes sometimes up to 30 minutes to dip the kettle completely into the molten zinc. During this period, the molten zinc heats up the steel and this leads to the burning (melting and disappearing) of the flux layer before it comes in contact with the molten zinc.

BRIEF SUMMARY

The invention provides a flux that makes it possible to produce continuous, more uniform, smoother and void-free coatings on iron or steel articles by hot dip galvanization with a molten zinc containing 5 to 500 ppm aluminum and the other usual alloying components (Ni, Sn, Pb, Bi, Mn, V . . . )

A flux for hot dip galvanization in accordance with the invention comprises the following proportions:

36 to 82 wt. % (percent by weight) of zinc chloride ($ZnCl_2$);

8 to 62 wt. % of ammonium chloride ($NH_4Cl$);

2.0 to 10 wt. % of a least one of the following compounds: $NiCl_2$, $MnCl_2$ or a mixture thereof.

The total of the above is 100 wt % except for the usual impurities.

By "hot dip galvanization" is meant the galvanizing of an iron or steel article by dipping it in a molten bath of zinc or zinc-alloy, in continuous or batch operation.

This flux should shows a better resistance to decomposition (destruction) in contact with hot turbulent air in the dryer or during the dipping procedure in the molten zinc bath and especially when this dipping procedure is very slow or interrupted for a while. Also this flux should better resists when molten zinc is splashed onto the fluxed parts.

Such a flux, wherein the different percentages relate to the proportion in weight of each compound or compound class relative to the total weight of the flux, makes it possible to produce continuous, more uniform, smoother and void-free coatings on iron or steel articles by hot dip galvanization in particular with zinc-200 to 500 ppm aluminum alloys, especially in batch operation. The selected proportion of $ZnCl_2$ ensures a good covering of the article to be galvanized and effectively prevents oxidation of the article during drying of the article, prior to the galvanization. The proportion of $NH_4Cl$ is determined so as to achieve a sufficient etching effect during hot dipping to remove residual rust or poorly pickled spots, while however avoiding the formation of black spots, i.e. uncovered areas of the article. The following compounds: $NiCl_2$, $MnCl_2$, improve the resistance of the flux to destruction in the dryer and/or when dipping the parts in the molten zinc or/and when a splash of zinc comes on fluxed parts and especially when using a Zn-200 to 500 ppm Al galvanizing alloy As mentioned, the present flux is particularly suitable for batch hot dip galvanizing processes using a zinc-200-500 ppm aluminum alloys bath but also a common, pure zinc bath. Moreover, the present flux can be used in continuous galvanizing processes using either zinc-aluminum or common, pure zinc baths, for galvanizing e.g. wires, pipes or coils (sheets) . . . . The term "pure zinc bath" is used herein in opposition to zinc-aluminum alloys and it is clear that pure zinc galvanizing baths may contain some, usual additives such as e.g. Pb, V, Bi, Ni, Sn, Mn . . . .

Regarding the zinc chloride, a proportion of 36% to 62% by weight is preferred, more preferably between 45% and 60%, most preferably between 54 and 58%. Alternatively the proportion of zinc chloride is between 38-42%.

A preferred proportion of zinc chloride of the flux is at least 38%, more preferably at least 42%, even more preferably at least 45% and most preferably at least 52%.

A preferred proportion of zinc chloride of the flux is at the maximum up to 62%, more preferably at the maximum up to 60%, even more preferably at the maximum up to 58% and most preferably at the maximum up to 54%.

Regarding the ammonium chloride ($NH_4Cl$), a proportion of 12 to 62% by weight is preferred, more preferably between 40 and 62%, most preferably between 40 and 46%. Alternatively the proportion of ammonium chloride ($NH_4Cl$) is between 58-62%.

A preferred proportion of ammonium chloride ($NH_4Cl$) of the flux is at least 12%, more preferably at least 20%, even more preferably at least 30% and most preferably at least 40%.

A preferred proportion of zinc chloride of the flux is at the maximum up to 62%, more preferably at the maximum up to 50%, even more preferably at the maximum up to 45% and most preferably at the maximum up to 40%.

The $NiCl_2$ and/or $MnCl_2$ content or mixtures thereof in the flux is preferably of up to 8%, more preferably up to 6% and even more preferably up to 5% and most preferably up to 4% by weight.

The $NiCl_2$ and/or $MnCl_2$ content or mixtures thereof in the flux is preferably at least 2.5%, more preferably at least 3% and even more preferably at least 3% and most preferably at least 4.5% by weight.

The $NiCl_2$ and/or $MnCl_2$ content or mixtures thereof in the flux is 2.7 wt. % of $NiCl_2$ or 2.7 wt. % $MnCl_2$ or a mixture of 0.9 to 2.7 wt % of $MnCl_2$ with 0.9 to 2.7 wt % of $NiCl_2$ with the provision that the $NiCl_2$+$MnCl_2$ content is at least 2 wt %

According to another aspect of the invention, a fluxing bath for hot dip galvanization is proposed, in which a certain amount of the above-defined flux is dissolved in water. The concentration of the flux in the fluxing bath may be between 200 and 700 g/l, preferably between 280 and 600 g/l, most preferably between 350 and 550 g/l. This fluxing bath is particularly adapted for hot dip galvanizing processes using zinc-aluminum baths, but can also be used with pure zinc galvanizing baths, either in batch or continuous operation.

The fluxing bath should advantageously be maintained at a temperature between 35 and 90° C., preferably between 40 and 60° C.

The fluxing bath may also comprise 0.01 to 2 vol. % (by volume) of a non-ionic surfactant, such as e.g. Merpol HCS from Du Pont de Nemours, FX 701 from Henkel, Netzer 4 from Lutter Galvanotechnik Gmbh (DE) or the like.

According to a further preferred embodiment, the flux contains less than 1.5% alkali metal salts and/or alkaline earth metal salts. Preferably, the flux contains less than 1.0% and even more preferably less than 0.5% alkali metal salts and/or alkaline earth metal salts.

According to a further aspect of the invention, a process for the hot dip galvanization of an iron or steel article is proposed. At a first process step (a), the article is submitted to a degreasing in a degreasing bath. The latter may advantageously be an ultrasonic, alkali degreasing bath. Then, in a second step (b), the article is rinsed. At further steps (c) and (d) the article is submitted to a pickling treatment and then rinsed. It is clear that these pre-treatment steps may be repeated individually or by cycle if needed. The whole pre-treatment cycle (steps a to d) can be carried out twice. The pickling step and its subsequent rinsing step can also be replaced by a shot blasting step. In both case, it shall be appreciated that at the next step (e) the article is treated in a fluxing bath in accordance with the invention so as to form a film of flux on the article's surface. The article may be immersed in the fluxing bath for up to 10 minutes, but preferably not more than 5 minutes. The fluxed article is subsequently dried (step f). At next step (g), the article is dipped in a hot galvanizing bath to form a metal coating thereon. The dipping time is a function of size and shape of the article, desired coating thickness, and of the aluminum content (when a Zn—Al alloy is used as galvanizing bath). Finally, the article is removed from the galvanizing bath and cooled (step h). This may be carried out either by dipping the article in water or simply by allowing it to cool down in the air.

The present process has been found to allow deposition of continuous, more uniform, smoother and void-free coatings on individual iron or steel articles, especially when a zinc-200-500 ppm-aluminum galvanizing bath was employed. It is particularly well adapted for the batch hot dip galvanizing of individual iron or steel articles, but also permits to obtain such improved coatings with wire, pipe or coil material continuously guided through the different process steps.

This process is applicable for a large variety of steel articles, such as e.g. large structural steel parts as for towers, bridges and industrial or agricultural buildings, pipes of different shapes as for fences along railways, steel parts of vehicle underbodies (suspension arms, engine mounts . . . ), castings, bolts and small parts.

The pretreatment of the article is firstly carried out by dipping the article to be galvanized for 15 to 60 minutes in an alkali degreasing bath comprising: a salt mix including mainly sodium hydroxide, sodium carbonate, sodium polyphosphate as well as a tenside mix, such as e.g. Solvopol SOP and Emulgator SEP from Lutter Galvanotechnik GmbH. The concentration of the salt mix is preferably between 2 and 8 wt. % and that of the tenside mix is preferably between 0.1 and 5 wt. %. This degreasing bath is kept at a temperature of 60° C. to 80° C. An ultrasonic generator is provided in the bath to assist the degreasing. This step is followed by two water rinsings.

The pretreatment then continues with a pickling step, wherein the article is dipped for 60 to 180 minutes in a 10 to 22% aqueous solution of hydrochloric acid containing an inhibitor (hexamethylene tetramine, . . . ) and kept at a temperature of 30 to 40° C. to remove scale and rust from the article. This again is followed by two rinsing steps. Rinsing after pickling is preferably carried out by dipping the article in a water tank at a pH lower than 1 for less than 3 minutes, more preferably for about 30 seconds. It is clear that these steps of degreasing and pickling can be repeated if necessary. Also these steps can be partially or completely replace by a steel blasting step. Then the parts are dipped in the flux, dried in a dryer or when the flux is hot the parts can be dried in the ambient air. Afterwards the parts are dipped in the molten zinc alloy Finally, the cooling of the coated article is carried out by dipping it in water having a temperature of 30° C. to 50° C. or alternatively, by exposing it to air. As a result, a continuous, uniform and smooth coating free from any voids, bare of spots, roughness or lumpiness, is formed on the article's surface.

BRIEF DESCRIPTION OF THE DRAWINGS

In order to further illustrate the present invention, three examples are provided and discussed here-below in relation to the figures where.

DETAILED DESCRIPTION, EXAMPLES

Example 1

Evaluation of the Flux Resistance when a Piece is Dipped Very Slowly or the Dipping Procedure is Interrupted In order to observe this phenomenon the tests on tubes from the company Baltimore Aircoil with a length of 200 mm (Diameter=25 mm, Thickness=1.5 mm) have been made. Three tubes were galvanized for each test condition in order to get a statistically consistent result. All these tubes have been prepared for the galvanization according the following pre-treatment steps:

- Alkaline degreasing during 10 min at 60° C.
- Rinsing
- Pickling for 30 min at 30° C. in a bath containing 95 g/l HCl and 125 g/l $FeCl_2$
- Rinsing (in 2 baths in cascade)
- Flux (see table no 1 here under): for 2 minutes with a fluxbath at 50° C. A wetting agent (Netzer 4 from the company Lutter Galvanotechnik GmbH) is added to the flux in order to wet the steel better and to make a more homogeneous flux layer on it.
- Drying 14 hours in a dryer with air at 120° C. with natural air convection (no ventilation: frequency controller on 0 Hz)
- Zinc alloy in wt %: 0.33 Sn—0.03 Ni—0.086 Bi—0.05 Al—0.022 Fe—0 Pb at 440° C.

Figure 1:
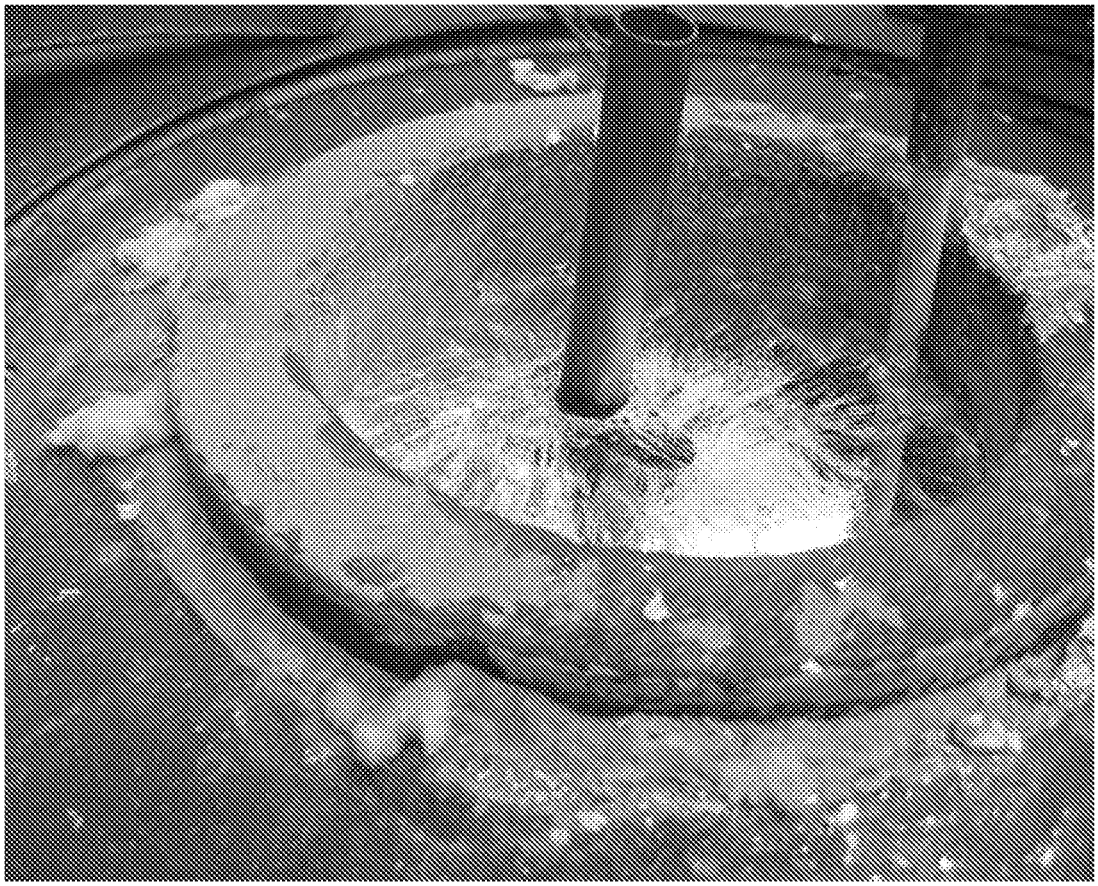
FIG. 1 represents a photo of the dipping being interrupted for 45 sec. in order to boost the degradation of the fluxfilm on the part of the tube just above the molten zinc bath level.

Dipping procedure: the tubes were dipped with a constant speed (0.5 m/min.) up to a depth of 100 mm below the zinc bath surface level (see FIG. 1) then the movement was stopped and they were remaining in that position for 45 sec. Afterward the tube were completely dipped (i.e. the remaining 100 mm) into the molten zinc bath (dipping speed=0.5 m/min). They were hanging in the zinc bath for 2 minutes before the starting the extraction step which occurred with a constant speed (0.5 m/min.)

During the time period when the dipping procedure is interrupted (see FIG. 1), the part of the tube which is still outside the molten zinc bath but close to the zinc bath surface and thus still covered with a dry flux layer) is submitted to very difficult conditions (very high temperature) and the flux layer is destroyed leading to ungalvanized zones after the galvanizing. It is therefore a well suited test.

TABLE 1

Composition of the different flux tested (example n ° 1)

| Nr.flux | Double salt 56 wt % $ZnCl_2$ + 44 wt % $NH_4Cl$ g/l | $NiCl_2$ g/l | $SnCl_2$ g/l | wt % | pH | Netzer4 ml/l |
|---|---|---|---|---|---|---|
| 1 | 550 | 0 | 0 | 0 | Natural | 3 |
| 2 | 550 | 5.5 | 0 | 1 | Natural | 3 |
| 3 | 550 | 16.5 | 0 | 3 | Natural | 3 |
| 4 | 550 | 5.5 | 0 | 1 | Natural | 0 |
| 5 | 550 | 16.5 | 0 | 3 | Natural | 0 |
| 8 | 550 | 0 | 5.5 | 1 | 2.0 | 3 |
| 9 | 550 | 0 | 2.75 | 0.5 | 2.0 | 3 |
| 10 | 560 | 0 | 0 | 0 | Natural | 0 |

The results are presented in table no 2 here below

TABLE n ° 2

Results of the tests

| Nr. flux | Nr. piece | Visual aspect After drying | Visual Aspect After galvanizing | Position in dryer |
|---|---|---|---|---|
| 1 | 18 | brown (but not completely) | 1 small ungalvanized spot | 1 |
| 8 | 19 | Light brown (50% grey and 50% brown) | 1 small ungalvanized spot | 6 |
| 9 | 20 | Perfectly grey | 2 small ungalvanized spots | 7 |
| 3 | 21 | Perfectly grey | Perfect | 8 |

TABLE n ° 2-continued

| Results of the tests | | | | |
|---|---|---|---|---|
| Nr. flux | Nr. piece | Visual aspect After drying | Visual Aspect After galvanizing | Position in dryer |
| 4 | | Light brown (50% grey and 50% brown) | 1 small ungalvanized spot | 13 |
| 5 | | Perfectly grey | Perfect | 15 |
| 1 | 22 | Brown | 1 small ungalvanized spot | 9 |
| 2 | 23 | Light brown (50% grey and 50% brown) | 1 small ungalvanized spot | 10 |
| 10 | 28 | Brown | 1 small ungalvanized spot | 11 |
| 2 | 24 | Light brown (50% grey and 50% brown) | 1 small ungalvanized spot | 2 |
| 3 | 25 | Perfectly grey | Perfect | 3 |
| 8 | 26 | Light brown (50% grey and 50% brown) | Some ungalvanized spot | 4 |
| 4 | | Light brown (50% grey and 50% brown) | 1 small ungalvanized spot | 14 |
| 5 | | Perfectly grey | Perfect | 16+ |
| 9 | 27 | Light brown (50% grey and 50% brown) | Some ungalvanized spots | 5 |
| 10 | 29 | Brown | small ungalvanized zones | 12 |

The tubes treated with flux 1 (classic flux without any addition except a wetting agent Netzer 4) present 1 small ungalvanized spot; the ones (flux 10) without Netzer 4 show small ungalvanized zones.

The tubes treated with flux 8 with $SnCl_2$ (5.5 g/l)—one of the 2 is perfect, the other one has a lot of black spots.

The tubes treated with flux 3 which contains $NiCl_2$ (16.5 g/l) are both perfect.

The tubes treated with flux 2 which contains $NiCl_2$ (5.5 g/l) are both not good.

The tubes treated with flux 9 with $SnCl_2$ (2.75 g/l)—one of the 2 shows small defects and the other ones are very badly galvanised.

Example No 2

These tests were also achieved on tubes from the company Baltimore Aircoil with a length of 200 mm (Diameter=25 mm, Thickness=1.5 mm). Three tubes were galvanized for each test condition in order to get a statistically consistent result. All these tubes have been prepared for the galvanization according the following pre-treatment steps:

- Alkaline degreasing during 10 min at 60° C.
- Rinsing
- Pickling for 30 min at 30° C. in a bath containing 95 g/l HCI and 125 g/l FeCl2
- Rinsing (in 2 baths in cascade)
- Flux (see table no 3 here under): for 2 minutes with a fluxbath at 50° C. A wetting agent (Netzer 4 from the company Lutter Galvanotechnik GmbH) is added to the flux in order to wet the steel better and to achieve a more homogeneous flux layer on it.
- Drying 14 hours in a dryer with air at 120° C. with natural air convection (no ventilation: frequency controller on 0 Hz)
- Zinc alloy in % weight: 0.33 Sn—0.03 Ni—0.086 Bi—0.05 Al—0.022 Fe—0 Pb, the remainder being Zinc with the usual impurities at 440° C.

The dipping procedure was exactly similar to the one of example no 1 but the dipping procedure was interrupted for 120 sec instead of 45 sec. The testing conditions are thus more difficult than in Ex. 1.

TABLE 3

| The test conditions of example n ° 2 | | | | | | |
|---|---|---|---|---|---|---|
| Nr.flux | | Concentration g/l | Netzer 4 ml/l | Fe2+ g/l | NiCl2 g/l (wt %) | pH 60° C. |
| 12 | Double Salt | 550 | 3 | 0 | 0 | 4 |
| 13 | Double Salt | 550 | 6 | 0 | 0 | 4 |
| 15 | Double Salt + Fe | 550 | 3 | 5 | 0 | 4 |
| 16 | Double Salt + Fe | 550 | 6 | 5 | 0 | 4 |
| 18 | Double Salt + Ni | 535 | 3 | 0 | 15 (2.73) | 3 |
| 19 | Double Salt + Ni | 535 | 6 | 0 | 15 (2.73) | 3 |
| 21 | Double Salt + Ni | 520 | 3 | 0 | 30 (5.45) | 3 |
| 22 | Double Salt + Ni | 520 | 6 | 0 | 30 (5.45) | 3 |
| 10 | Double Salt | 550 | 0 | 0 | 0 | 4 |
| 11 | Double Salt + Ni | 535 | 0 | 0 | 15 (2.73) | 3 |

TABLE 4

| Description of the results of the tests of example n ° 2 | | | | |
|---|---|---|---|---|
| Nr. flux | Nr. Piece | Visual aspect after drying | Visual Aspect After galvanizing | Position in dryer |
| 12 | 30 | perfect grey | Thick ungalvanized line (30 × 5 mm): very bad | 1 |
| 12 | 31 | perfect grey | Thick ungalvanized line (30 × 5 mm): very bad | 1 |
| 13 | 32 | perfect grey | 5 limited ungalvanised spots of d = 1 mm | 5 |
| 13 | 33 | perfect grey | bad, ungalvanised line | 5 |
| 15 | 36 | perfect grey | 1 limited ungalvanised spot (2 × 5 mm) | 2 |
| 15 | 37 | perfect grey | 1 small ungalvanised spot d = 0.5 mm | 2 |
| 16 | 38 | perfect grey | 1 small ungalvanised spot d = 0.5 mm | 6 |
| 16 | 39 | perfect grey | 4 small ungalvanised spots of d = 0.5 mm | 6 |
| 18 | 42 | perfect grey | Perfect | 3 |
| 18 | 43 | perfect grey | Perfect | 3 |
| 19 | 44 | perfect grey | Perfect | 7 |
| 19 | 45 | perfect grey | Perfect | 7 |
| 21 | 48 | perfect grey | Perfect | 4 |
| 21 | 49 | perfect grey | Perfect | 4 |
| 22 | 50 | perfect grey | Perfect | 8 |
| 22 | 51 | perfect grey | Perfect | 8 |
| 10 | 54 | perfect grey | Thick ungalvanized line (30 × 5 mm) around the tube: very bad | 13 |
| 10 | 55 | perfect grey | Thick ungalvanized line (30 × 5 mm) around the tube: very bad | 13 |
| 11 | 56 | perfect grey | Perfect | 14 |
| 11 | 57 | perfect grey | Perfect | 14 |

Results and conclusions of these tests:

All tubes present a perfect grey colour after the drying step. This is different compared to the test of example 1 and can be due to the humidity conditions (Relative humidity of the air) of the day of the test.

Tubes prepared with classic double salt flux (10, 12, 13) show small to very extended galvanizing fault.

The tubes which present a perfect quality after galvanizing are the ones treated with the flux that contains 15 g/l $NiCl_2$.

The presence of 5 g/l $Fe^{2+}$ in the flux leads to poor galvanizing quality on Baltimore tubes. The quality is a little bit better than the ones obtained with the flux without Fe (Flux 15 and 16 are leading to better results than flux 12&13 and 10). This better resistance to burning of the flux can be due to the thicker flux layer on the tubes when $FeCl_2$ is added to the flux which is a phenomenon already observed in the literature.

Example No 3

In this test, the influence of the presence of $MnCl_2$, $NiCl_2$ and the combination of both $MnCl_2$+$NiCl_2$ in the flux have been tested. Identical tubes from the company Baltimore as in the previous examples were used in order to evaluate the resistance of these fluxes.

The pre-treatment procedure, residence time in the flux, the dryer and the zinc bath are exactly identical as those of example 2. The zinc bath composition is also identical as the one of example no 2.

TABLE 5

Composition of the flux tested in example n ° 3

| Nr.flux | Flux type | Conc. g/l | Netzer 4 ml/l | $MnCl_2$ wt % related to the total salt content | $NiCl_2$ wt % related to the total salt content | pH At 60° C. |
|---|---|---|---|---|---|---|
| 31 | Double salt + Ni | 545 | 3 | 0 | 0.9 | 3 |
| 32 | Double salt + Ni | 540 | 3 | 0 | 1.82 | 3 |
| 18 | Double salt + Ni | 535 | 3 | 0 | 2.7 | 3 |
| 33 | Double salt + Mn | 545 | 3 | 0.9 | 0 | 3 |
| 34 | Double salt + Mn | 540 | 3 | 1.82 | 0 | 3 |
| 29 | Double salt + Mn | 535 | 3 | 2.7 | 0 | 3 |
| 29bis | Double salt + Mn | 535 | 0 | 2.7 | 0 | 3 |
| 35 | Double salt + Mn + Ni | 540 | 3 | 0.9 | 0.9 | 3 |
| 36 | Double salt + Mn + Ni | 535 | 3 | 1.82 | 0.9 | 3 |
| 37 | Double salt + Mn + Ni | 530 | 3 | 2.7 | 0.9 | 3 |
| 38 | Double salt + Mn + Ni | 530 | 3 | 1.82 | 1.82 | 3 |
| 39 | Double salt + Mn + Ni | 530 | 3 | 0.9 | 2.7 | 3 |
| 40 | Double salt + Mn + Ni | 520 | 3 | 2.7 | 2.7 | 3 |
| 28 | Double salt | 550 | 3 | 0 | 0 | natural |
| 28bis | Double salt | 550 | 0 | 0 | 0 | natural |

Double salt in this context means: $ZnCl_2 \cdot 2NH_4Cl$

TABLE 6

Results of the tests of example n ° 3

| Nr. flux | Nr. tube | Aspect after drying | Aspect after galvanizing | Position in the dryer |
|---|---|---|---|---|
| 31 | 96 | grey with white spots | 2 ungalvanized spots | 1 |
| 31 | 97 | grey with white spots | 4 ungalvanized spots | 6 |
| 31 | 98 | grey with white spots | Very bad | 12 |
| 33 | 99 | grey with white spots | Bad | 2 |
| 33 | 100 | grey with white spots | Bad | 7 |
| 33 | 101 | grey with white spots | Bad | 13 |
| 35 | 102 | grey with white spots | Bad | 3 |
| 35 | 103 | grey with white spots | Very bad | 8 |
| 35 | 104 | grey with white spots | Very bad | 14 |
| 37 | 105 | grey with white spots | Very good | 4 |
| 37 | 106 | grey with white spots | Very good | 9 |
| 37 | 107 | grey with white spots | Very good | 17 |
| 38 | 108 | grey with white spots | Very good | 5 |
| 38 | 109 | grey with white spots | good | 10 |
| 38 | 110 | grey with white spots | Very good | 18 |
| 28 | 111 | grey with white spots | 3 small ungalvanized spots | 11 |
| 28 | 112 | grey with white spots | Bad | 15 |
| 28 | 113 | grey with white spots | 3 small ungalvanized spots | 16 |
| 32 | 114 | grey with white spots | 2 small ungalvanized spots | 1 |
| 32 | 115 | grey with white spots | 1 small ungalvanized spot | 2 |
| 32 | 116 | grey with white spots | 1 ungalvanized spot | 3 |
| 18 | 117 | grey with white spots | Good | 4 |
| 18 | 118 | grey with white spots | Very good | 5 |
| 18 | 119 | grey with white spots | Very good | 6 |
| 34 | 120 | grey with white spots | 1 small ungalvanized spot | 7 |
| 34 | 121 | grey with white spots | 1 small ungalvanized spot | 8 |
| 34 | 122 | grey with white spots | 2 small ungalvanized spots | 9 |
| 29 | 123 | grey with white spots | Very good | 10 |
| 29 | 124 | grey with white spots | Very good | 11 |
| 29 | 125 | grey with white spots | Very good | 12 |
| 28bis | 126 | grey with white spots | ungalvanized spots | 13 |
| 28bis | 127 | grey with white spots | 2 small ungalvanized spot | 14 |

TABLE 6-continued

Results of the tests of example n ° 3

| Nr. flux | Nr. tube | Aspect after drying | Aspect after galvanizing | Position in the dryer |
|---|---|---|---|---|
| 28bis | 128 | grey with white spots | 1 small ungalvanized spot | 15 |
| 36 | 129 | grey with white spots | Very good | 1 |
| 36 | 130 | grey with white spots | good | 2 |
| 36 | 131 | grey with white spots | good | 3 |
| 39 | 132 | grey with white spots | Very good | 4 |
| 39 | 133 | grey with white spots | Very good | 5 |
| 39 | 134 | grey with white spots | Very good | 6 |
| 40 | 135 | grey with white spots | Very good | 7 |
| 40 | 136 | grey with white spots | Very good | 8 |
| 40 | 137 | grey with white spots | Very good | 9 |
| 28 | 138 | grey with white spots | Bad | 10 |
| 28 | 139 | grey with white spots | Very bad | 11 |
| 28 | 140 | grey with white spots | 4 ungalvanized spots | 12 |
| 29bis | 141 | grey with white spots | Very good | 13 |
| 29bis | 142 | grey with white spots | Very good | 14 |
| 29bis | 143 | grey with white spots | Very good | 15 |

Results and Conclusions of the Tests of Example 3:

The tubes pre-treated with the double salt flux with 2.7 wt % (15 g/l) $MnCl_2$ (29&29bis) present the best quality after galvanizing (3 out of 3 are very good) or with the combinations of 0.9 wt % (5 g/l) $MnCl_2$+2.7 wt % (15 g/l) $NiCl_2$ (39) or 2.7 wt % (15 g/l) $MnCl_2$+0.9 wt % (5 g/l) $NiCl_2$ (37). The flux based on double salt flux with 2.7 wt % (15 g/l) $NiCl_2$ (18) or with the combinations 1.82 wt % (10 g/l) $MnCl_2$+1.82 wt % (10 g/l) $NiCl_2$ (38) or 1.82 wt % (10 g/l) $MnCl_2$+0.9 wt % (5 g/l) $NiCl_2$ (36) lead also to good results.

The tubes pre-treated with the double salt flux with (28) or without (28bis) Netzer4 are not OK because the flux layer just above the zinc surface was destroyed. The tubes pre-treated with the other flux are in-between the double salt flux without additive and the best ones cited earlier.

Figures 2A, 2B, 3:
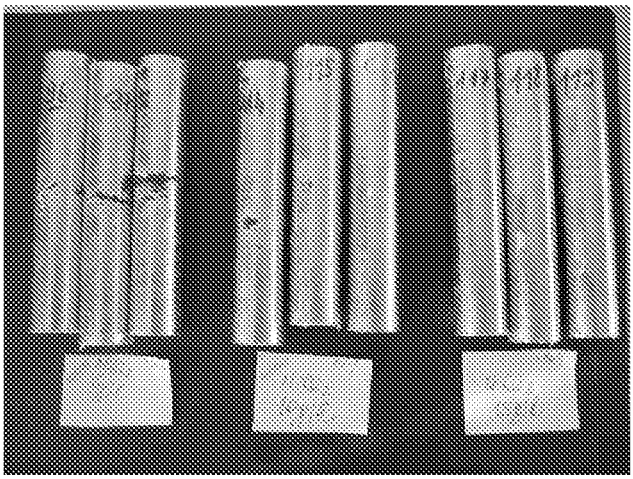
FIG. 2*a* represents an elevation view of the position of the articles in the dryer according to Example 1.
FIG. 2*b* represents an elevation view of the position of the article in the dryer according to Example 2 and 3.
FIG. 3 represents a photo showing the influence of the $MnCl_2$ concentration in the flux.

The comparison of the tubes pre-treated in a flux containing 5 (0.9 wgt %), 10 (1.82 wgt %) or 15 (2.7 wgt %) g/l $MnCl_2$ shows that the flux with 15 g/l $MnCl_2$ gives the best results (see FIG. 3). This result is 100% reproducible!

Figure 4:
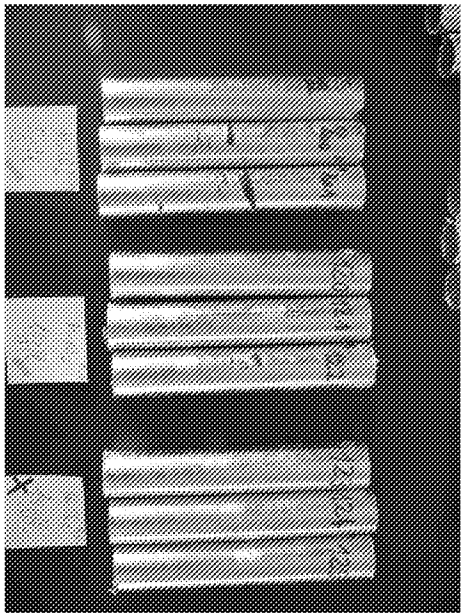
FIG. 4 represents a photo showing the influence of $NiCl_2$ the concentration in the flux.

Exactly the same conclusion can be made for the flux containing 5-10-15 g/l $NiCl_2$ as shown on FIG. 4.

The invention claimed is:

1. A process for hot dip galvanization of an iron or steel article comprising:

a) degreasing the article in a degreasing bath;

b) rinsing the article;

c) pickling the article;

d) rinsing the article;

e) treating the article in a fluxing bath comprising between 200 and 700 g/l of the flux, said flux comprising on a weight percent basis:

36 to 60 wt. % zinc chloride (ZnCl2), 8 to 62 wt. % ammonium chloride (NH4Cl), 2.0 to 10 wt. % NiCl2, MnCl2 or a mixture thereof, wherein the total of the above salts is 100% by weight of said flux;

f) drying the article or letting the article dry in the ambient air;

g) dipping the article in a hot dip galvanizing bath of zinc-200-500 ppm aluminium alloys, or of common pure zinc to form a metal coating thereon; and h) cooling the article in water based solution or with air.

2. The process according to claim 1, wherein at step (e) the article is immersed in the fluxing bath for up to 10 minutes.

3. The process according to claim 2, wherein at step (f) the article is dried by means of air at a temperature between 100 and 200° C.

4. The process according to claim 1, wherein ammonium chloride is present in an amount of 40 to 62 wt. % of the flux.

5. The process according to claim 1, wherein $NiCl_2$ or $MnCl_2$ or a mixture thereof is present in the flux in an amount of 3 wt. % of the flux.

6. The process according to claim 1, wherein the fluxing bath is maintained at a temperature between 30 and 90° C.

7. The process according to claim 1, wherein the fluxing bath comprises a non-ionic or an anionic surfactant in a concentration of between 0.01 to 2 vol. %.

8. The process according to claim 1, wherein $NiCl_2$ is present in an amount of 2.7 wt. % of the flux.

9. The process according to claim 1, wherein $MnCl_2$ is present in an amount of 2.7 wt. % of the flux.

10. The process according to claim 1, wherein a mixture of $MnCl_2$ and $NiCl_2$ is present in the flux in an amount of at least 2 wt % of the flux, and wherein the $MnCl_2$ is present in an amount of 0.9 to 2.7 wt % of the flux, and $NiCl_2$ is present in an amount of 0.9 to 2.7 wt % of the flux.

11. A process of hot dip galvanization of an iron or steel article comprising:

degreasing the article in a degreasing bath;

rinsing the article;

pickling the article;

rinsing the article;

treating the article in a fluxing bath comprising between 200 and 700 g/l of a flux, wherein the flux consists of on a weight percent basis:

36 to 60 wt. % of zinc chloride ($ZnCl_2$), 8 to 62 wt. % of ammonium chloride ($NH_4Cl$), 2 to 10 wt. % of $NiCl_2$, $MnCl_2$ or a mixture thereof;

drying the article or letting the article dry in the ambient air;

dipping the article in a hot dip galvanizing bath of zinc-200-500 ppm aluminum alloys, or of common pure zinc to form a metal coating thereon; and cooling the article in water based solution or with air.

* * * * *